US011512914B2

(12) United States Patent
Schott et al.

(10) Patent No.: US 11,512,914 B2
(45) **Date of Patent: *Nov. 29, 2022**

(54) FIREARM SHELL CASING CATCHING SYSTEM

(71) Applicant: MAGWELL MOUNTS, LLC, Sunman, IN (US)

(72) Inventors: Kara Schott, Sunman, IN (US); Richard Knueven, Sunman, IN (US); Joseph Eckstein, Sunman, IN (US)

(73) Assignee: Magwell Mounts, LLC, Sunman, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/399,191

(22) Filed: Aug. 11, 2021

(65) Prior Publication Data

US 2022/0065566 A1 Mar. 3, 2022

Related U.S. Application Data

(63) Continuation of application No. 17/011,969, filed on Sep. 3, 2020, now Pat. No. 11,137,225.

(51) Int. Cl.

| | |
|---|---|
| ***F41A 9/60*** | (2006.01) |
| ***F41A 5/00*** | (2006.01) |
| ***F41A 15/00*** | (2006.01) |

(52) U.S. Cl.

CPC ..... *F41A 9/60* (2013.01); *F41A 15/00* (2013.01)

(58) Field of Classification Search

CPC ..... F41A 9/60
USPC ..... 42/98
See application file for complete search history.

(56) References Cited

U.S. PATENT DOCUMENTS

| | | | | |
|---|---|---|---|---|
| 4,028,834 | A | 6/1977 | Dobson | |
| 4,334,375 | A | 6/1982 | Olson | |
| 4,594,803 | A | 6/1986 | Muncy | |
| 4,715,141 | A | 12/1987 | Kohnke | |
| 4,903,426 | A | 2/1990 | Bammate | |
| 4,959,918 | A | 10/1990 | Perez | |
| 5,138,787 | A | 8/1992 | Riddle et al. | |
| 5,398,439 | A | 3/1995 | Harless | |
| 5,651,208 | A | 7/1997 | Benson | |
| 5,934,002 | A | 8/1999 | Blanchet | |
| 6,173,520 | B1 * | 1/2001 | Bucciarelli | F41A 9/60 42/98 |
| 6,687,513 | B1 | 2/2004 | Hsu Li | |
| 7,168,200 | B2 | 1/2007 | Perez et al. | |
| 8,156,855 | B2 | 4/2012 | Anderson | |
| 9,360,264 | B2 | 6/2016 | Rosenthal | |
| 9,366,491 | B1 | 6/2016 | Baxley | |
| 9,915,486 | B1 | 3/2018 | Churchill | |
| 9,945,626 | B2 | 4/2018 | Rosenthal | |
| 10,107,578 | B1 | 10/2018 | Mirabel | |
| 10,184,740 | B1 | 1/2019 | Churchill | |
| 11,137,225 | B1 * | 10/2021 | Schott | F41A 9/60 |
| 2006/0101699 | A1 * | 5/2006 | Perez | F41A 9/60 42/98 |
| 2012/0023803 | A1 | 2/2012 | Taylor | |

FOREIGN PATENT DOCUMENTS

| | | | |
|---|---|---|---|
| DE | 4300867 | A1 | 7/1993 |

* cited by examiner

*Primary Examiner* — Bret Hayes
(74) *Attorney, Agent, or Firm* — Ulmer & Berne LLP

(57) ABSTRACT

A firearm shell casing catching system for collecting casings ejected from a firearm includes a mounting assembly, casing deflector, and a hopper.

20 Claims, 8 Drawing Sheets

FIREARM SHELL CASING CATCHING SYSTEM

CROSS-REFERENCE TO RELATED APPLICATIONS

This application is a continuation of U.S. patent application Ser. No. 17/011,969, filed on Sep. 3, 2020, entitled FIREARM SHELL CASING CATCHING SYSTEM, the disclosure of which is incorporated by reference herein in its entirety.

TECHNICAL FIELD

The systems and methods described below relate to firearms. More particularly, the systems and methods relate to firearm accessories for capturing spent ammunition.

BACKGROUND

Ammunition for most firearms has a conventional construction. Generally, firearm ammunition consists of a cartridge which includes components that are consumed and components that must be ejected from the firearm. Conventional cartridges include a jacket or casing, a bullet seated in the casing, propellant contained within the casing behind the bullet, and a primer which ignites the propellant. The propellant is a highly incendiary and combustive material; when it is ignited, very hot combustion gases are quickly formed and expand outwardly, causing the casing to expand outward and causing the bullet to burst forward. The primer controls the ignition of the propellant; the primer may be a pressure- or impact-sensitive chemical upon which a firing pin acts.

When a firing pin impacts the primer, the propellant combusts, and the bullet is sent hurtling out of the casing within the barrel of the firearm. The bullet exits the muzzle toward a target. The propellant and the primer are consumed during combustion. The casing, however, is not consumed and not jettisoned from the firearm. Rather, the casing is left expanded within the firing chamber. It must be cleared before a fresh cartridge can be fired. Cycling of the firearm will eject the casing. In some firearms, this is done manually by retracting the bolt so that the casing pops out of the ejection port. In other firearms, ejection occurs automatically as a feature of the operating system. With either method, the casing is cleared from the firing chamber so that a new cartridge may be introduced and shot.

Casings are conventionally made from brass, and as such, the community often refers to ejected casings as "spent brass." Spent brass can be a hazard. First, it can get quite hot. As it is ejected, spent brass may drop in place or it may be launched a few inches to feet away, and bystanders hit by hot spent brass can be burned. Second, in an increasingly environmentally-minded world, it is irresponsible to allow spent brass to remain on the ground. A shooter may have quite a bit of spent brass. However, it can be burdensome to pick up casings from the ground after ejection.

Brass catchers were developed to tackle the problem of spent brass. Such brass catchers are bulky, difficult to use, and can be laborious in their attachment mechanism, as they often require extensive mounting hardware

BRIEF DESCRIPTION OF THE DRAWINGS

It is believed that certain embodiments will be better understood from the following description taken in conjunction with the accompanying drawings, in which like references indicate similar elements and in which.

DETAILED DESCRIPTION

Figure 1:
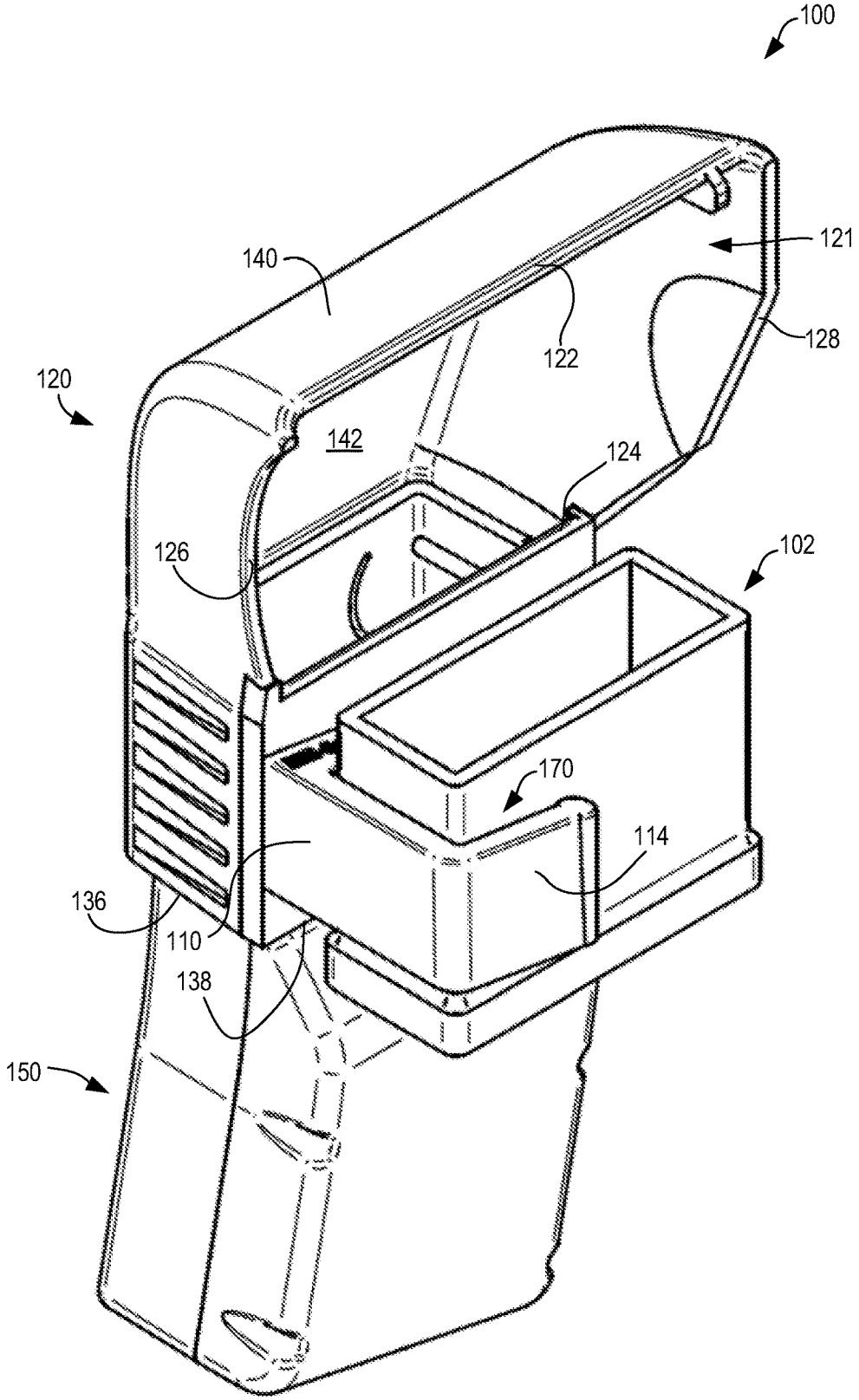
FIG. 1 is an isometric view of a firearm shell casing catching system attached to a magwell of a firearm in accordance with one embodiment.

Various non-limiting embodiments of the present disclosure will now be described to provide an overall understanding of the principles of the structure, function, and use of the disclosed firearm shell casing catching system. One or more examples of these non-limiting embodiments are illustrated in the selected examples disclosed and described in detail with reference made to FIGS. 1-14 in the accompanying drawings. The examples discussed herein are examples only and are provided to assist in the explanation of the systems and methods described herein. None of the features or components shown in the drawings or discussed below should be taken as mandatory for any specific implementation of any of these systems or methods unless specifically designated as mandatory. For ease of reading and clarity, certain components or methods may be described solely in connection with a specific figure. In this disclosure, any identification of specific techniques or arrangements is either related to a specific example presented or is merely a general description of such a technique, arrangement, and so forth. Identifications of specific details or examples are not intended to be, and should not be, construed as mandatory or limiting unless specifically designated as such. Any failure to specifically describe a combination or sub-combination of components should not be understood as an indication that any combination or sub-combination is not possible. It will be appreciated that modifications to the disclosed and described examples, arrangements, configurations, components, elements, apparatuses, devices, systems, methods, etc. can be made and may be desired for a specific application. Also, for any methods described, regardless of whether the method is described in conjunction with a flow diagram, it should be understood that, unless otherwise specified or required by context, any explicit or implicit ordering of steps performed in the execution of a method does not imply that those steps must be performed in the order presented but, instead, may be performed in a different order or in parallel.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

The present disclosure generally relates to firearm shell casing catching systems. Various firearm shell casing catching systems in accordance with the present disclosure can be attached and removed from a firearm with one hand. Furthermore, the firearm shell casing catching systems disclosed herein can be rigid and sturdy enough to allow a user to carry the firearm by holding the firearm shell casing catching system without need to reposition the device. As described in more detail below, firearm shell casing catching systems in accordance with the present disclosure can also include a detachable hopper that can be removed with ease. In some embodiments, the hopper can hold spent casings from an entire 30-round magazine. Moreover, in some embodiments, the firearm shell casing catching system can contact the firearm at no more than two points of contact and secures to the firearm without screws, fasteners, hardware or straps.

Figure 2:
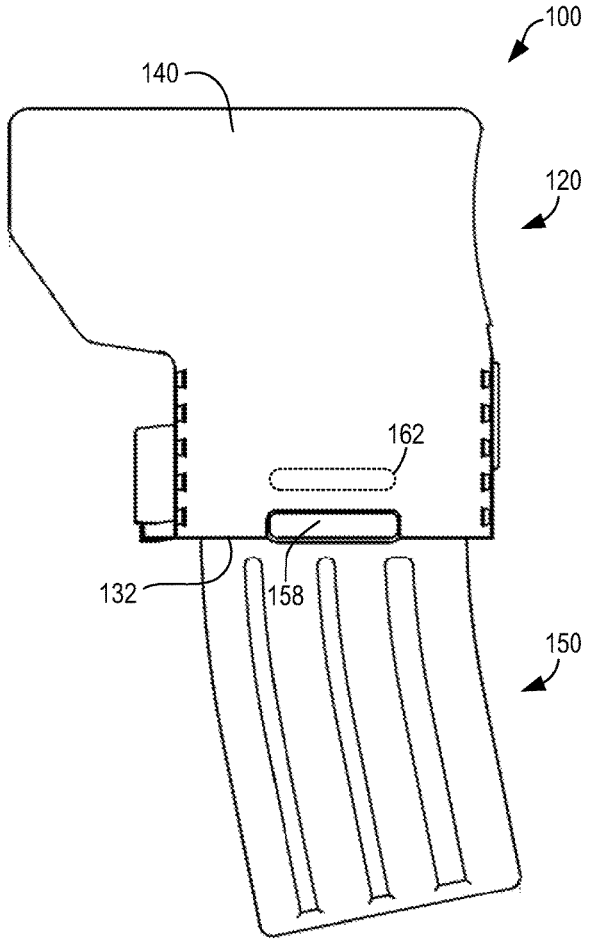
FIG. 2 is a side view of the firearm shell casing catching system of FIG. 1.
Figure 3:
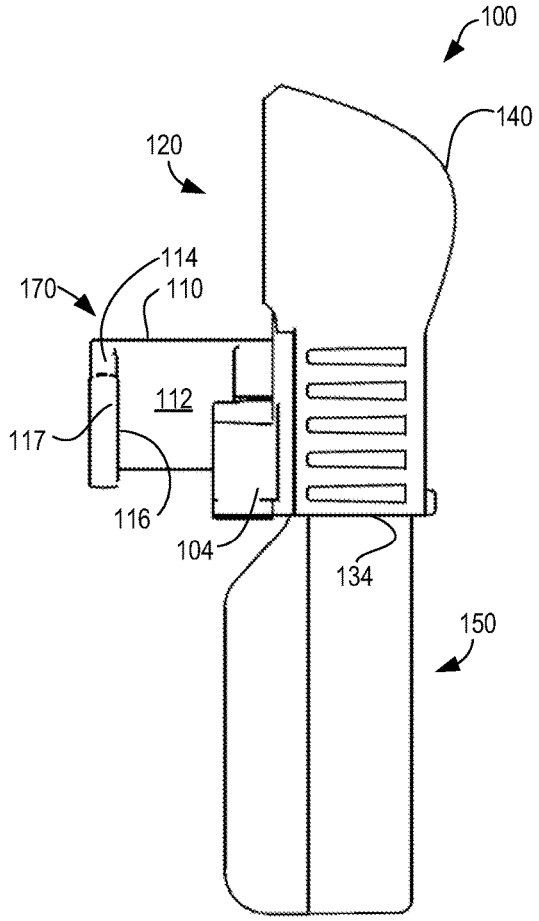
FIG. 3 is a rear view of the firearm shell casing catching system of FIG. 1.
Figure 4:
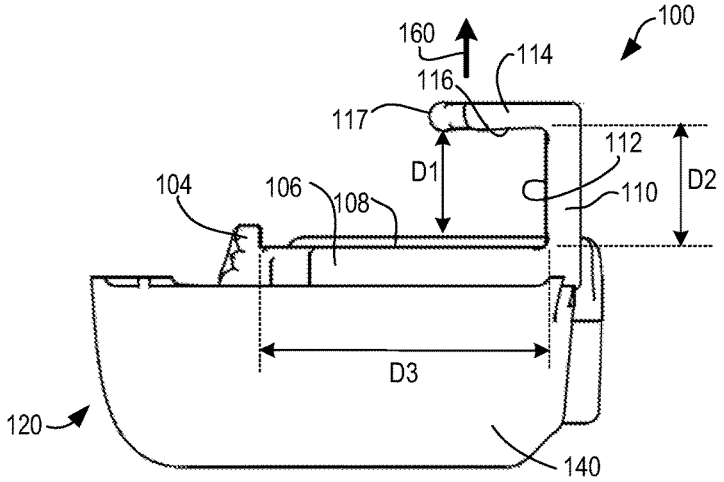
FIG. 4 is a top view of the firearm shell casing catching system of FIG. 1
Figure 5:
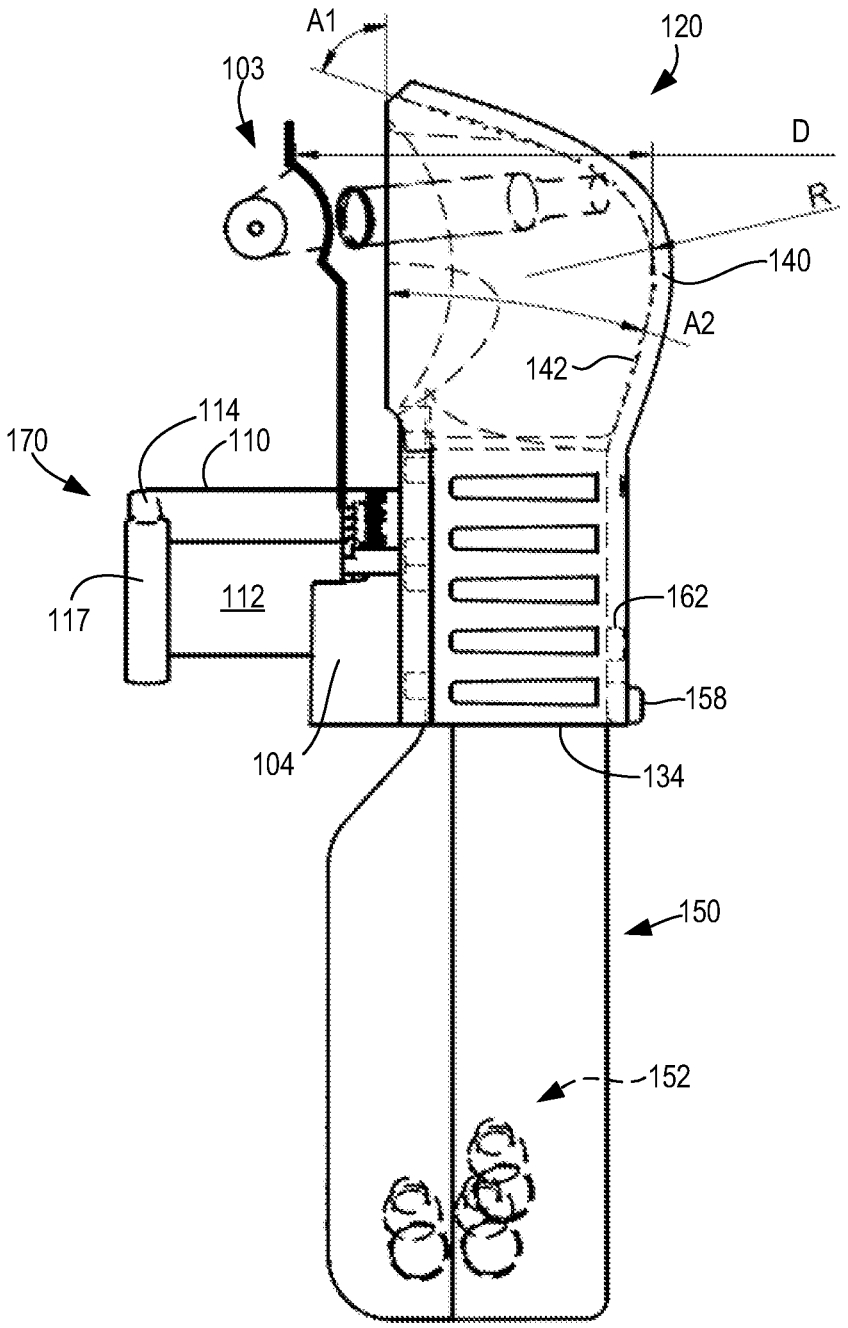
FIG. 5 is another rear view of the firearm shell casing catching system of FIG. 1.
Figure 7:
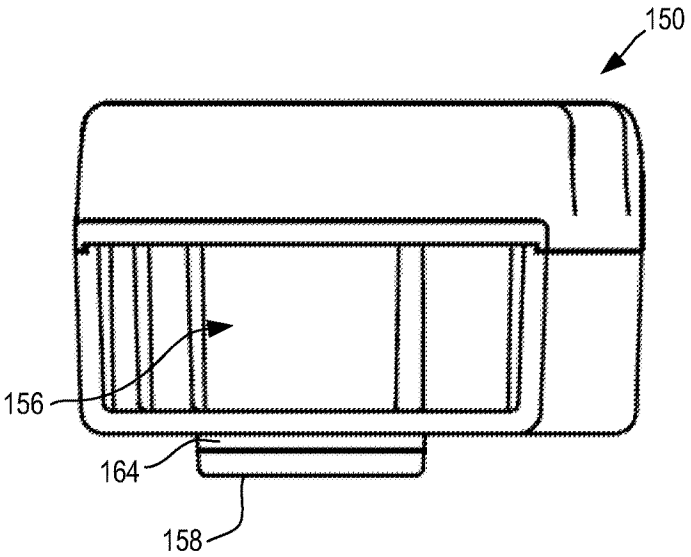
FIG. 7 is a top view of the hopper of FIG. 6.
Figure 6:
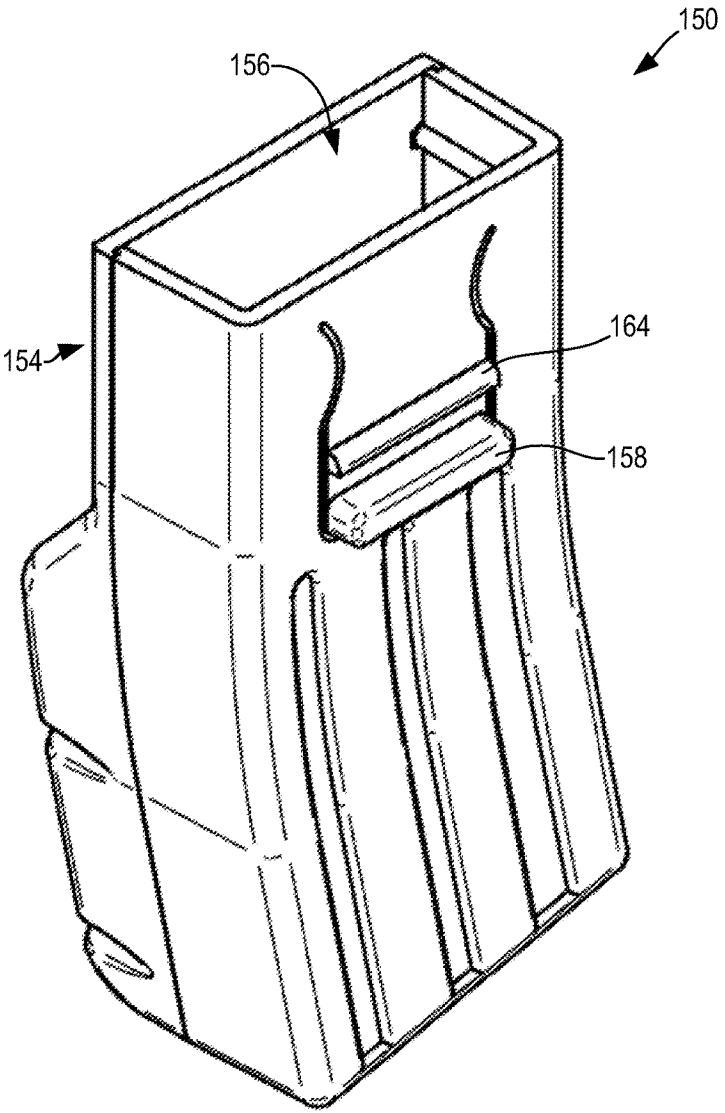
FIG. 6 is an isometric view of a hopper in accordance with one embodiment.
Figure 9:
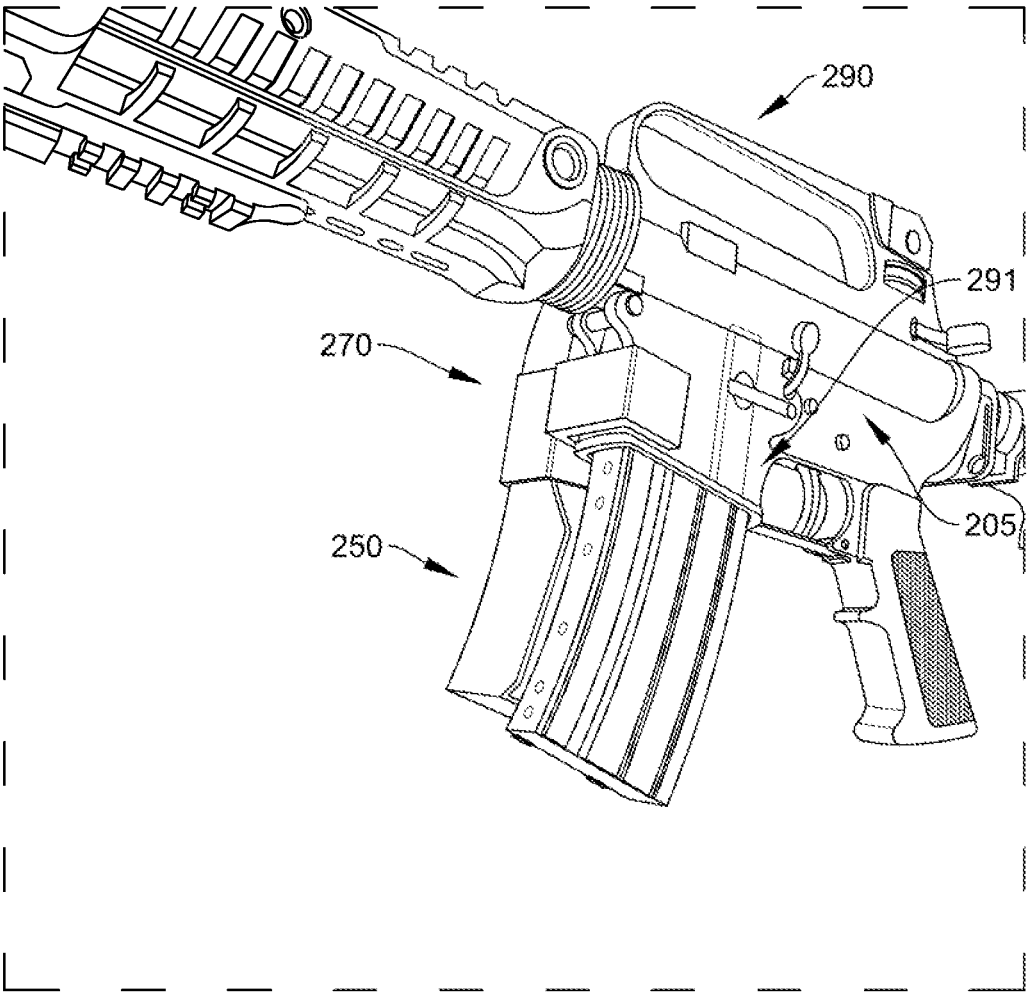
Figure 10:
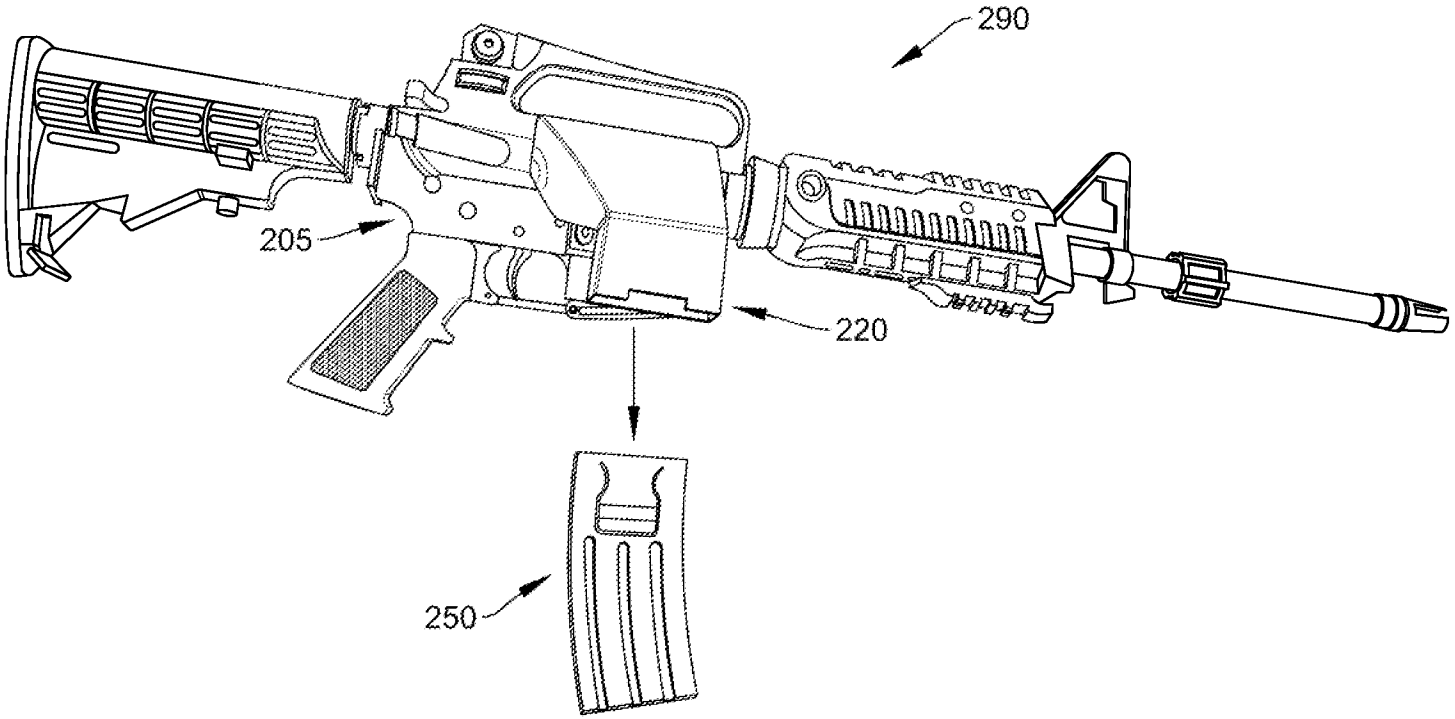

Referring now to FIGS. 1-7, an example firearm shell casing catching system 100 in accordance with one embodiment is depicted. FIG. 1 is an isometric view of the firearm shell casing catching system 100 attached to a magwell 102 of a firearm. The remainder of the firearm has been removed for clarity of illustration. As is to be appreciated to one skilled in the art, the magwell 102 can be a component of a receiver of the firearm that is configured to receive a magazine of ammunition. An example receiver 205 is shown in FIGS. 9-10. FIG. 2 is a side view of the firearm shell casing catching system 100. FIG. 3 is a rear view of the firearm shell casing catching system 100. FIG. 4 is a top view of the firearm shell casing catching system 100. FIG. 5 is another rear view of the firearm shell casing catching system 100. FIG. 6 is an isometric view of a hopper 150 of the firearm shell casing catching system 100 in accordance with one embodiment. FIG. 7 is a top view of the hopper 150.

The firearm shell casing catching system 100, when attached to a portion of the receiver of a firearm, such the magwell 102 (FIG. 1), can collect casings ejected from an ejection port of the firearm. An ejection port 103 of a firearm is schematically depicted in FIG. 5. The firearm shell casing catching system 100 can include a mounting assembly 170 for selectably attaching the firearm shell casing catching system 100 to a firearm. The mounting assembly 170 can include a rear tab 104, a first side wall 106 defining a first inside surface 108, a front wall 110 defining a second inside surface 112, and a second side wall 114 defining a third inside surface 116. The first inside surface 108 and the third inside surface 116 can be substantially parallel, as shown in FIG. 4.

As shown FIG. 1, the mounting assembly 170 can partially surround the magwell 102. To enable attachment to a magwell, the second side wall 114 can be slightly outwardly deflectable, as depicted by arrow 160 in FIG. 4. The configuration of the mounting assembly 170 can beneficially allow for one-handed attachment and detachment. In some embodiments, the amount of force created when the second side wall 114 deflects during attachment is about 8 pounds of force, although this disclosure is not so limited.

The second side wall 114 can include a vertical rib 117 that is positioned at its proximal end. In some embodiments, it is the vertical rib 117 that contacts the magwell of the receiver, as the vertical rib 117 can protrude from the third inside surface 116. In some embodiments, the vertical rib 117 is separated from the first inside surface 108 by a distance D1. Distance D1 can be, for example, slightly less than the thickness of a magwell. In some embodiments, distance D1 is about 1.08 inches. The forward most inside dimension of the mounting assembly 170, shown as distance D2, can be about 1.11 inches. In some embodiments, distance D3 is about 2.64 inches. For a magwell having a thickness of 1.1 inches, the second side wall 114 can deflect outwardly by about 0.02 inches to accept and capture the magwell between the vertical rib 117 and the first inside surface 108. Thus, the magwell 102 is generally locked between the vertical rib 117 and the rear tab 104 until the user wishes to detach the firearm shell casing catching system 100 from the firearm. To detach, the firearm shell casing catching system 100 can be slightly twisted to cause outward deflection of the mounting assembly 170 such that the magwell 102 can be released from the rear tab 104. Once released from the rear tab 104, the firearm shell casing catching system 100 can be slid away from the magwell 102.

Figure 12:
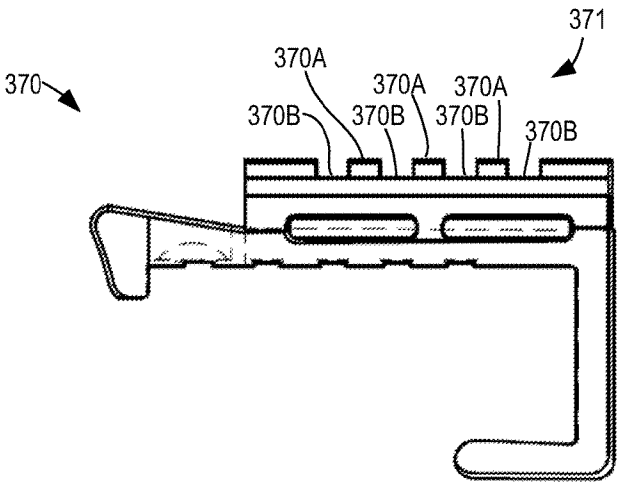
FIGS. 11-14 depict an example mounting assembly having a mounting rail system in accordance with one embodiment.
Figure 14:
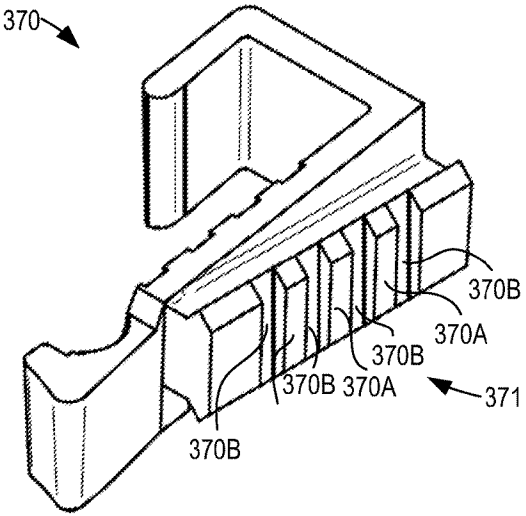
Figure 11:
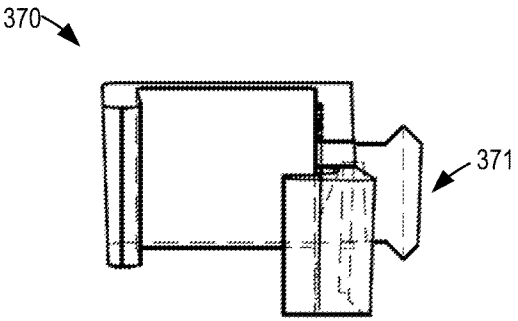
Figure 13:
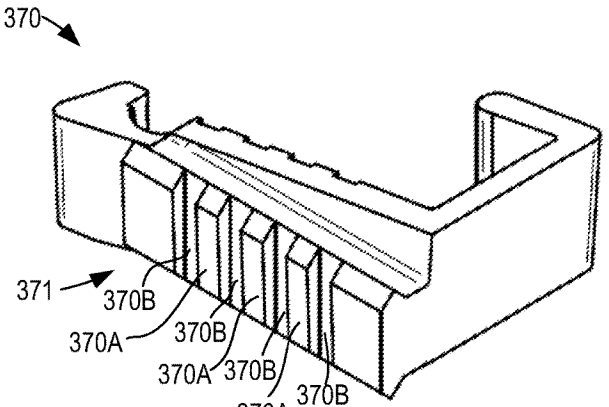

The firearm shell casing catching system 100 can also include a casing deflector 120 that is coupled to the mounting assembly 170. In some embodiments, the casing deflector 120 is integral (i.e., unitary) with the mounting assembly 170. In other embodiments, the casing deflector 120 can be coupled to the mounting assembly 170 via an adhesive, a mounting rail system, or any other suitable coupling technique. An example mounting rail system is depicted in FIGS. 11-13. The casing deflector 120 can define an internal chamber having an upper opening 121 (FIG. 1) defined by an upper edge 122, a lower edge 124, a first side edge 126, and a second side edge 128. In some embodiments, the first side edge 126 can be curved, as shown in FIG. 1, to allow for the geometries of the firearm. Various components of the firearm shell casing catching system 100 can be formed from ABS plastic, for example. Additionally or alternatively, various components can be formed from other types of plastics, ferrous metals, nonferrous metals, among other types of materials. Further, various components of the firearm shell casing catching system 100 can be manufactured through any suitable manufacturing process or combination of manufacturing process, such as injection molding, stamping, 3D printing, machining of parts, and forth.

Furthermore, the casing deflector 120 can be sized and configured to allow for typical operation of the firearm, such as the opening of a hinged dust cover over the ejection port. In an open position, for example, the dust cover can generally bridge a gap between the lower edge 124 and the side of the firearm.

The casing deflector 120 can also define a lower opening defined by a first edge 132, a second edge 134, a third edge 136, and a fourth edge 138. As described in more detail below, a portion of the hopper 150 can be received through the lower opening of the casing deflector 120. The casing deflector 120 can also comprise a rigid outer wall 140 that defines an inner deflecting surface 142. The inner deflecting surface 142 can extend between the upper edge 122 and the first edge 132. As shown in FIG. 5, at least a portion of the inner deflecting surface 142 can be curved. Such curvature can aid in deflecting the spent casing downward toward the hopper 150 as opposed to ricocheting back toward the ejection port 103. Additionally, the casing deflector 120 can beneficially serve to deflect gases and/or particulates that are expelled from the ejection port during firing. Such deflection of gases/particulates can be particularly beneficially to lefthanded shooters, as well as when firearms are fired with a suppressor attached to the barrel, as firearms with suppressors typical expel additional gas through the ejection port.

Still referring to FIG. 5, a portion of the inner deflecting surface 142 that is proximate to the upper edge 122 (FIG. 1) of the upper opening 121 can be downwardly angled towards the lower opening, as shown by angle A1. In some embodiments, angle A1 is between about 40 degrees and about 80 degrees. In some embodiments, angle A1 is about 71 degrees. Additionally, the curved portion of the inner deflecting surface 142 can have a radius of curvature, as shown by radius of curvature R. In some embodiments, the radius of curvature R is about 0.79 inches. A portion of the inner deflecting surface 142 that is positioned between the lower opening and the curved portion can have an angle A2. This portion can help transition the inner deflecting surface 142 from the curved section to the planar section that received the hopper 150. In some embodiments, angle A2 is about 17 degrees.

Furthermore, the overall size of the firearm shell casing catching system 100 can be based on the size of casings being captured and the size/type of the firearm. In one embodiment, for example, a distance D between an ejection portion 103 and a portion of the inner deflecting surface 142 is about 2.2 inches, although this disclosure is not so limited. For instance, in some embodiments the distance D is between about 1.5 inches and 1.7 inches. In some embodiments, the distance D is greater than about 1.7 inches. In some embodiments, the distance D is less than about 4 inches. Furthermore, as shown in FIG. 5, a gap between the casing deflector 120 and the firearm can allow for visibility of the ejection port 103.

The hopper 150 of the firearm shell casing catching system 100 can be selectably attachable to the casing deflector 120. Furthermore, when the casing deflector 120 is attached to a firearm, the firearm can be fired with or without the hopper 150 attached. The hopper 150 can define a casing storage chamber 152 for collecting spent casings. FIG. 5 schematically depicts spent casings being stored in the hopper 150. While the size of the casing storage chamber 152 can vary, in some embodiments, the casing storage chamber can store about 30 spent casings.

The hopper can comprise an insertion portion 154 (FIG. 6) that is sized similarly to the lower opening of the casing deflector 120, such that the insertion portion 154 can be received through the lower opening. In some embodiments, both of the insertion portion 154 and the lower opening have a rectangular cross section. The insertion portion 154 can also define a hopper opening 156 through which spent casings enter the hopper 150. In some embodiments, the hopper opening 156 is about 2.2 inches by about 0.87 inches, although this disclosure is not so limited.

The hopper 150 can be latched onto the casing deflector 120 until a user wishes to detach the hopper 150. In some embodiments, for example, the hopper 150 includes a release tab 164 that protrudes from an outer surface of the hopper 150. The casing deflector 120 can define a corresponding hopper mounting slot 162 (FIG. 5) that is sized to receive the release tab 164. The hopper 150 can also include a release button 158. Depressing the release button 158 can cause the release tab 164 to withdraw from the hopper mounting slot 162, thereby allowing the hopper 150 to be pulled downward from the casing deflector 120 to detach the hopper 150. Beneficially, such detachment can be performed one-handed.

Figure 8:
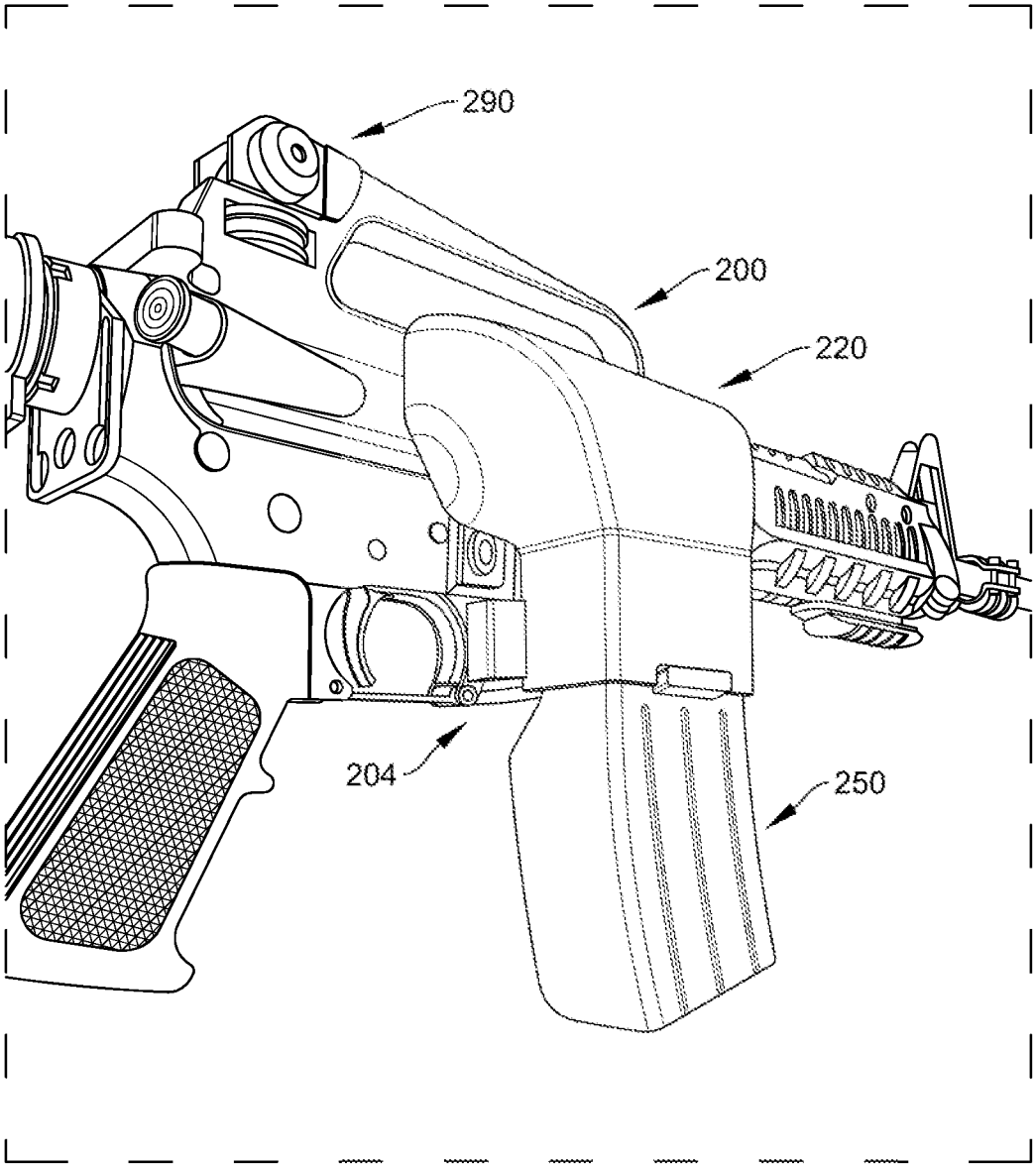
FIGS. 8-10 depict a firearm shell casing catching system mounted to a firearm in accordance with one embodiment.

Referring now to FIGS. 8-10, an example firearm shell casing catching system 200 is shown mounted to a firearm 290 in accordance with one embodiment. In particular, FIG. 8 depicts a rear tab 204 of the firearm shell casing catching system 200 and a hopper 250 inserted and latched to a casing deflector 220. FIG. 9 shows a portion of the mounting assembly 270 partially surrounding the magwell 291 of the receiver 205. As shown, the firearm shell casing catching system 200 does not require screws, specialized fasteners, straps, or other mounting equipment. FIG. 10 shows the hopper 250 removed from the casing deflector 220. The firearm 290 depicted in FIG. 10 can still be fired with the hopper 250 removed, as the casing deflector 220 will still beneficially deflect the spent casings downward and out of a lower opening of the casing deflector 220. Furthermore, while FIGS. 8-10 depict a firearm shell casing catching system attached to an AR 15, it is to be readily appreciated that firearm shell casing catching systems in accordance with the present disclosure can be attached to a wide variety of firearms, including hand guns, for example.

Referring now to FIGS. 11-14, a mounting assembly 370 in accordance with one embodiment is depicted. The mounting assembly 370 can selectably be attached to a receiver of a firearm in a similar fashion as the mounting assemblies 170 and 270, described above. The illustrated mounting assembly 370 has a mounting rail system 373 that is defined by a plurality of vertical ridges 370A and grooves 370B. Various fireman accessories can have a corresponding mounting rail system to allow for such accessories to be selectably attached to the mounting assembly 370. By way of the example, a casing deflector (similar to casing 120, for example) can have a mounting rail system that is configured to engage with the mounting rail system 373 of the mounting assembly 370. Additionally or alternatively, other accessories that can be attached to the mounting rail system 373 can include, without limitation, a flashlight, an extra magazine, among others.

The dimensions and/or values disclosed herein are not to be understood as being strictly limited to the exact numerical dimensions and/or values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these sorts of focused discussions would not facilitate a better understanding of the present invention, and therefore, a more detailed description of such elements is not provided herein.

These and other embodiments of the systems, apparatuses, devices, and methods can be used as would be recognized by those skilled in the art. The above descriptions of various systems, apparatuses, devices, and methods are intended to illustrate specific examples and describe certain ways of making and using the systems, apparatuses, devices, and methods disclosed and described here. These descriptions are neither intended to be nor should be taken as an exhaustive list of the possible ways in which these systems, apparatuses, devices, and methods can be made and used. A number of modifications, including substitutions between or among examples and variations among combinations can be made. Those modifications and variations should be apparent to those of ordinary skill in this area after having read this disclosure.

What is claimed is:

1. A firearm shell casing catching system for collecting casings ejected from a firearm, the firearm having an ejection port and a receiver, the firearm shell casing catching system comprising:

a mounting assembly selectively attachable to a firearm receiver, the mounting assembly comprising a rear tab, a first side wall defining a first inside surface, a front wall defining a second inside surface, and a second side wall defining a third inside surface;

a casing deflector coupled to the mounting assembly, the casing deflector defining a chamber having an upper opening and a lower opening, wherein the case deflector comprises an outer wall, the outer wall defining an inner deflecting surface extending between the upper opening and the lower opening; and a hopper selectably attachable to the casing deflector, the hopper defining a casing storage chamber, wherein the hopper defines a hopper opening.

2. The firearm shell casing catching system of claim 1, wherein a portion of the mounting assembly is outwardly deflectable.

3. The firearm shell casing catching system of claim 1, further comprising a release tab and a mounting slot, wherein the release tab is receivable into the mounting slot.

4. The firearm shell casing catching system of claim 1, wherein a portion of the inner deflecting surface proximate to the upper opening is downwardly angled towards the lower opening.

5. The firearm shell casing catching system of claim 1, wherein the portion of the inner deflecting surface proximate to the upper opening is downwardly angled between about 40 degrees and about 80 degrees.

6. The firearm shell casing catching system of claim 1, wherein the portion of the inner deflecting surface proximate to the upper opening is downwardly angled at about 71 degrees.

7. The firearm shell casing catching system of claim 1, wherein a portion of the inner deflecting surface is curved.

8. The firearm shell casing catching system of claim 7, wherein when mounted to a receiver of a firearm, a portion of the curved portion of the inner deflecting surface is about 2.2 inches from a casing ejection port.

9. The firearm shell casing catching system of claim 1, wherein the mounting assembly comprises an ABS plastic.

10. The firearm shell casing catching system of claim 1, wherein the mounting assembly is integrally formed with the casing deflector.

11. The firearm shell casing catching system of claim 1, wherein the hopper is attached to the casing deflector, the chamber of the casing deflector is in communication with the casing storage chamber of the hopper.

12. A firearm shell casing catching system for collecting casings ejected from a firearm, the firearm having an ejection port and a receiver, the firearm shell casing catching system comprising:

a mounting assembly selectively attachable to a firearm receiver;

a casing deflector coupled to the mounting assembly, the casing deflector defining a chamber having an upper opening defined by an upper edge, a lower edge, a first side edge, and a second side edge and a lower opening defined by a first edge, a second edge, a third edge, and a fourth edge, wherein the casing deflector comprises an outer wall, the outer wall defining an inner deflecting surface extending between the upper edge and the first edge, wherein a portion of the inner deflecting surface proximate to the upper edge of the upper opening is downwardly angled towards the lower opening; and a hopper selectably attachable to the casing deflector, the hopper defining a casing storage chamber, wherein the insertion hopper defines a hopper opening.

13. The firearm shell casing catching system of claim 12, wherein the portion of the inner deflecting surface proximate to the upper edge of the upper opening is downwardly angled between about 40 degrees and about 80 degrees.

14. The firearm shell casing catching system of claim 12, wherein the portion of the inner deflecting surface proximate to the upper edge of the upper opening is downwardly angled at about 71 degrees.

15. The firearm shell casing catching system of claim 12, wherein a portion of the inner deflecting surface is curved.

16. The firearm shell casing catching system of claim 15, wherein when mounted to a receiver of a firearm, a portion of the curved portion of the inner deflecting surface is about 2.2 inches from a casing ejection port.

17. A firearm shell casing catching system for collecting casings ejected from a firearm, the firearm having an ejection port and a receiver, the firearm shell casing catching system comprising:

a mounting assembly selectively attachable to a firearm receiver;

a casing deflector coupled to the mounting assembly, the casing deflector defining a chamber having an upper opening and a lower opening, wherein the casing deflector comprises an outer wall, the outer wall defining an inner deflecting surface extending between an upper edge and a first edge, wherein a first portion of the inner deflecting surface proximate to the upper edge of the upper opening is downwardly angled between about 40 degrees and about 80 degrees; and a hopper selectably attachable to the casing deflector proximate to the lower opening wherein the hopper defines a hopper opening.

18. The firearm shell casing catching system of claim 17, wherein the first portion of the inner deflecting surface proximate to the upper edge of the upper opening is downwardly angled at about 71 degrees.

19. The firearm shell casing catching system of claim 17, wherein a second portion of the inner deflecting surface is curved.

20. The firearm shell casing catching system of claim 17, wherein the inner deflecting surface defines a curved deflecting surface, wherein a portion of the curved deflecting surface is about 2.2 inches from a casing ejection port.

* * * * *